US006632488B2

(12) United States Patent
Okumura et al.

(10) Patent No.: US 6,632,488 B2
(45) **Date of Patent: *Oct. 14, 2003**

(54) INK JET RECORDING MATERIAL

(75) Inventors: Yoshitaka Okumura, Chiba (JP); Takaaki Kohro, Chiba (JP); Yoshiharu Kawashima, Tokyo (JP); Hiromasa Kondo, Urawa (JP)

(73) Assignee: OJI Paper Co., LTD, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/253,758

(22) Filed: Feb. 22, 1999

(65) Prior Publication Data

US 2003/0068473 A1 Apr. 10, 2003

(30) Foreign Application Priority Data

Feb. 26, 1998 (JP) ..... 10-045172
May 13, 1998 (JP) ..... 10-129788

(51) Int. Cl.[7] ..... B41M 5/00
(52) U.S. Cl. ..... 428/32.25; 428/32.18; 428/32.34; 428/32.37
(58) Field of Search ..... 428/331, 328, 428/329, 330, 195, 522, 32.18, 32.25, 32.34, 32.37

(56) References Cited

U.S. PATENT DOCUMENTS 4,900,620 A * 2/1990 Tokita et al.
5,856,001 A * 1/1999 Okumura et al. ..... 428/331

FOREIGN PATENT DOCUMENTS

| | | |
|---|---|---|
| EP | 0 423 829 A1 | 4/1991 |
| JP | 52-53012 | 4/1977 |
| JP | 53-49113 | 5/1978 |
| JP | 55-51583 | 4/1980 |
| JP | 56-148585 | 11/1981 |
| JP | 58-110287 | 6/1983 |
| JP | 59-185690 | 10/1984 |
| JP | 61-141584 | 6/1986 |
| JP | 62-95285 | 5/1987 |
| JP | 3-199081 | 8/1991 |
| JP | 4-16379 | 1/1992 |

OTHER PUBLICATIONS

Database WPI, Section Ch, Week 199551; Derwent Publications Ltd., London, GB; Class A97, AN 1995–400362, XP002126657 & JP 07 276786A, Oct. 24, 1995 (Abstract).
Abstract of Japanese Patent Publ. No. 10046498; dated Feb. 17, 1998.
Abstract of Japanese Patent Publ. No. 08100388, dated Apr. 16, 1996.

* cited by examiner

*Primary Examiner*—Pamela R. Schwartz
(74) *Attorney, Agent, or Firm*—Arent Fox Kintner Plotkin & Kahn, PLLC

(57) ABSTRACT

An ink jet recording material which includes a paper sheet substrate and an ink receiving layer containing a xerogel porous pigment and has excellent ink-absorption and reproducibility of ink images with high clarity and precision, exhibits a water-dipping expansion of 0.3% or less, determined by the same method as the JAPAN TAPPI No. 27-B method except that the length of the recording material immersed in water is measured 15 seconds after the start of the immersion.

8 Claims, No Drawings

INK JET RECORDING MATERIAL

BACKGROUND OF THE INVENTION

1. Field of the Invention

The present invention relates to an ink jet recording material. More particularly, the present invention relates to an ink jet recording material usable for an ink jet recording system, in which aqueous ink images are recorded on recording material, having an excellent ink-absorption and capable of recording ink images having high clarity and precision with an excellent reproducibility.

2. Description of the Related Art

The ink jet recording system using an aqueous ink is advantageous in that the noise of the ink jet recording operation is low, colored images can be easily recorded, and the recording can be effected at a high speed. Therefore, the ink jet recording system is widely utilized in terminal printers, facsimile machines, and plotter machines and for printing account books and slips. Since the conventional woodfree paper sheets and coated paper sheets which are usable for usual printing have a poor ink-absorption, the ink images applied on surfaces of the conventional paper sheets remain in a non-dried condition over a long time, and the wetted ink images stain the printers and the printed sheets, and thus the ink images, per se, are solid. Therefore, conventional woodfree paper sheets and coated paper sheets are not practically useful for the ink jet recording system. To solve the above-mentioned problems, Japanese Unexamined Patent Publication No. 52-53012 discloses a recording paper sheet having a low degree of sizing and Japanese Unexamined Patent Publication No. 53-49,113 discloses a recording sheet produced by preparing a paper sheet from an aqueous paper-forming pulp slurry containing a urea-formaldehyde resin and then impregnating the resultant urea-formaldehyde resin-containing paper sheet with a water-soluble polymer.

Further, various types of ink jet recording sheets having a surface layer coated on a paper sheet substrate and containing inorganic porous pigment particles, for example, amorphous silica particles are disclosed, for example, in Japanese Unexamined Patent Publications No. 55-51,583 and No. 56-148,585, for the purpose of improving the quality of the colored images of the ink and the reproducibility of the colored ink images. Also, Japanese Unexamined Patent Publications No. 58-110,287, No. 59-185,690 and No. 61-141,584 disclose various types of porous pigment particles useful for forming a ink receiving layer capable of receiving thereon ink images having high precision and clarity, which preventing a blotting of the printed ink images.

With popularization of the ink jet recording system, the ink jet recording material is required to have both a satisfactory pencil writing property, as an office recording sheet, and a sufficient aqueous ink recording property. To meet the requirements, Japanese Unexamined Patent Publication No. 4-16,379 discloses to use two types of porous pigment particles different in average radius of pores from each other, together, to form the ink receiving layer.

However, since the recent development of the ink jet printing technology is very significant and the precision of the printer has been enhanced, an ink jet recording material having an image quality similar to the image quality of silver salt photography is required.

To meet with the above-mentioned requirement, it is necessary to make the range of reproducible colors broad.

For this purpose, the amount of the inks applied onto the recording material tends to increase. Therefore, the recording material must have an increased ink-receiving capacity and an enhanced resistance to cockling of the recording material due to the increased amount of the applied ink.

When aqueous ink images are recorded on a recording material including a substrate comprising a paper sheet, the recorded material may be cockled or corrugated. This phenomenon is referred to as a cockling phenomenon. When the cockling phenomenon occurs, the distance between the recording material surface and the recording head and the contact angle of the recording head with the recording material surface may locally vary, and thus the intervals between ink droplets applied to the recording material surface and the sizes of the ink droplets become uneven, and the positions of the printed ink dots become inaccurate. Therefore, the resultant print has a decreased degree of precision and accuracy, and the printed ink images have a low quality. In a certain case, the cockled recording material comes into contact with the recording head, the recorded ink images are stained by the recording head, the recording material is broken by the recording head and further the recording head is broken.

The cockling phenomenon is assumed to be generated due to the following reasons.

Namely, when aqueous ink jets are applied to a recording material surface, a water component in the aqueous ink penetrates into the paper sheet substrate, through the ink-receiving layer and is absorbed by the pulp fibers in the paper sheet substrate to cause the pulp fibers to swell. It is well known that when the pulp fibers are swollen with water, the degrees of swelling of the pulp fibers in the longitudinal direction thereof and the transverse direction in a right angle with the longitudinal direction are different from each other to a great extent. When the paper sheet is produced by a paper-forming machine, the pulp fibers are mainly oriented in the flow direction in the paper-forming machine. Therefore, the swelling degree of the paper sheet is much higher in the transverse direction than that in the longitudinal (machine) direction. Namely, the paper sheet is anisotropic in the swelling direction. Also, when the ink jets are applied to the recording sheet surface, the amount of the applied ink is variable in response to the pattern of images. Namely, the amount of the applied ink is small in the images having a low density of color and is large in the images having a high density of color. Therefore, the position in the recording material printed with a high color density image has a high swelling degree of the pulp fibers in the paper sheet substrate. The cockling phenomenon of the recording material is generated due to the anisotropy in the water-swelling property of the paper sheet substrate, the unevenness in the amount of the applied aqueous ink, and the unevenness in the swelling degree of the aqueous ink-applied portions of the recording material. Therefore, in the ink jet recording material having a paper sheet substrate, it is very difficult to solve or reduce the cockling problem.

Japanese Unexamined Patent Publications No. 62-95,285 and No. 3-199,081 disclose methods for removing or reducing the cockling problem on the ink jet recording material. In the method of Japanese Unexamined Patent Publication No. 62-95,285, the coating layer is dried under specifically restricted conditions, for example, by a cast-coating procedure, because when the coated recording material is dried under the usual drying conditions, the ultimate elongation of the recording material wetted with water cannot be controlled to a level of 2.0% or less. Also, the Japanese publication provides a drying procedure in which a paper sheet for a substrate of the recording material is dried under specifically restricted conditions and by, for example, a Yankee drier. Also, Japanese Unexamined Patent Publication No. 3-199,081 discloses a method of producing an ink jet recording material having enhanced resistance to cockling, in which method, to make the difference in the degree of fiber orientation of the pulp fibers between the longitudinal and transverse directions in the paper sheet substrate as small as possible, the ratio in the ultimate elongation of the paper sheet substrate wetted in water in the longitudinal direction (machine direction) to that in the transverse direction is controlled to 1.3 or less. These methods are satisfactory to a certain extent, but are unsatisfactory to provide a ink jet recording material capable of recording ink images with high precision and clarity.

SUMMARY OF THE INVENTION

An object of the present invention is to provide an ink jet recording material capable of recording ink images having excellent clarity and precision with a high reproducibility.

Another object of the present invention is to provide an ink jet recording material having a high ink absorption and an enhanced resistance to cockling of the recording material.

The above-mentioned objects can be attained by the ink jet recording material of the present invention which comprises a paper sheet substrate and an ink receiving layer formed on the paper sheet substrate and comprising a xerogel porous pigment, the ink jet recording material exhibiting a water-dipping expansion of 0.3% or less, determined in accordance with the same method as the JAPAN TAPPI No. 27-B method, except that the length of the recording material immersed in water is measured 15 seconds after the start of the immersion.

The ink jet recording material of the present invention preferably exhibits a water-dipping expansion of 0.3% or less, determined in accordance with the same method as the JAPAN TAPPI No. 27-B method, except that the length of the recording material immersed in water is measured 30 seconds after the start of the immersion.

In the ink jet recording material of the present invention, preferably the paper sheet substrate has a Stöckigt sizing degree of 25 to 150 seconds, per 100 g/m$^2$ of the basis weight of the paper sheet substrate.

In the ink jet recording material of the present invention, preferably the ink receiving layer comprises an under recording layer coated on the paper sheet substrate and an upper recording layer coated on the under recording layer, and the under recording layer comprises a mixed pigment comprising 25 to 75% by weight of a xerogel porous pigment in the form of fine porous particles having a BET specific surface area of 100 m$^2$/g or more, more preferably 100 to 500 m 2/g, and 75 to 25% by weight of a non-xerogel pigment in the form of particles having a BET specific surface area of 100 m$^2$/g or less, more preferably 50 m$^2$/g or less.

The ink jet recording material of the present invention preferably has a bulk density of 0.75 to 1.30 g/cm$^3$ and a thickness of 100 to 300 $\mu$m, determined in accordance with Japanese Industrial Standard (JIS) P8118.

In the ink jet recording material of the present invention, preferably the paper sheet substrate is one coated or impregnated with a polyvinyl alcohol compound and a sizing agent.

In the ink jet recording material of the present invention, preferably the non-xerogel pigment comprises at least one member selected from the group consisting of calcium carbonate and calcined kaolin.

In the ink jet recording material of the present invention, preferably the paper sheet substrate comprises a paper sheet in which the cellulose molecules are cross-linked with a cross-linking agent comprising at least one member selected from the group consisting of dialdehyde starches, polyamide-epichlorohydrin resins, polyamide-epoxide resins, urea-formaldehyde resins and melamine-formaldehyde resins, the cross-linking agent having been applied to the paper sheet by adding it into an aqueous pulp slurry for forming the paper sheet, or coating or impregnating the paper sheet with the cross-linking agent.

In the ink jet recording material of the present invention in which the ink receiving layer has an under recording layer and an upper recording layer, preferably the upper recording layer comprises xerogel porous pigment particles preferably having a BET specific surface area of 100 m$^2$/g or more.

DESCRIPTION OF THE PREFERRED EMBODIMENTS

The ink jet recording material comprises a paper sheet substrate and an ink receiving layer formed on the paper sheet substrate and containing a xerogel porous pigment, and exhibits a water-dipping expansion of 0.3% or less, determined in accordance with the same method as the JAPAN TAPPI No. 27-B method, except that the length of the recording material immersed in water is measured 15 seconds after the start of the immersion.

The water-dipping expansion of a paper sheet represents an increase in length of the paper sheet during dipping in water. It is considered that the larger the water-dipping expansion of the paper sheet, the higher the degree of cockling occurred on the paper sheet.

The water-dipping expansion of the paper sheet is determined after the paper sheet is immersed in water for 5 minutes in accordance with the JAPAN TAPPI No. 27-B method. The cockling phenomenon occurs on an aqueous ink-printed paper sheet during procedures in which a small amount of the aqueous ink is applied imagewise to the paper sheet, the applied aqueous ink coheres on and is absorbed in the paper sheet, and then the absorbed aqueous ink is dried. The conditions under which the water-dipping expansion of the paper sheet is measured and the conditions under which the cockling phenomenon occurs on an aqueous ink-printed paper sheet are greatly different in the amount of the water applied to the paper sheet, and the time for which the paper sheet is kept dripped in water, from each other. To prevent or reduce the cockling phenomenon on the ink jet recording material, a detailed investigation should be conducted on the behaviour of the recording material printed with the ink jets at a stage immediately after the printing, but not after the immersion of the recording material in water for a long time.

One of the reasons for the fact that the ink jet recording materials disclosed in Japanese Unexamined Patent Publications No. 62-95285 and No. 3-199081 are not satisfactory to prevent or reduce the cockling phenomenon occurred on the aqueous ink jet-printed recording material, is as stated above.

The pulp for forming the paper sheet for the substrate comprises at least one member selected from chemical pulps, for example, softwood bleached kraft pulps (NBKP) and hardwood bleached kraft pulps (LBKP); mechanical pulps, for example, groundwood pulp (GP), bleached chemithermomechanical pulp (BCTMP) and mechanical pulp (MP); non-wood pulps obtained from non-wood materials, for example, Kenaf pulp and hemp pulp; and DIP pulp. The pulp is optionally mixed with at least one type of synthetic fibers, for example, polyolefin fibers, for example, polyethylene fibers, polypropylene fibers, ethylene-propylene copolymer fibers, and etheylene-vinyl acetate copolymer fibers; polystyrene fibers; halogen-containing polymer fibers, for example, polyvinyl chloride fibers and polyvinylidene chloride fibers; polyamide fibers, for example, nylon-6 fibers and nylon-66 fibers; aliphatic polyester fibers, for example, polyethylene succinate fibers, and polyhydroxy-butyrate-valerate copolymer fibers, polycaprolactone fibers and polylactic acid fibers; and water-insolubilized polyvinyl alcohol fibers. Also, the paper sheet for the substrate optionally contains, as a filler, a pigment comprising at least one member selected from inorganic pigments, for example, talc, kaolin, calcined kaolin, calcium carbonate, white carbon, amorphous silica, diatomaceous earth, titanium dioxide, activated clay and barium sulfate; and organic pigments, for example, urea-formaldehyde resin powder, nylon resin powder, and polyethylene resin powder. The paper sheet for the substrate may be produced by an acid paper-forming method or a neutral paper forming method.

Further, the paper sheet for the substrate optionally contains an additive comprising at least one member selected from rosin compound-containing sizing agents, alkenylsuccinic acid anhydride-containing sizing agents, alkylketene dimer-containing sizing agents, water-soluble polymeric compounds, for example, starch compounds, for example, oxidized starches, enzyme-modified starches, cation-modified starches, esterified starches and etherified starches, cellulose compounds, for example, methylcellulose, ethylcellulose, carboxymethylcellulose, methoxycellulose, and hydroxycellulose, polyvinyl alcohol compounds, for example, completely saponified and partially saponified polyvinyl alcohols, carboxy-modified polyvinyl alcohols, silicone-modified polyvinyl alcohols, and cation-modified polyvinyl alcohols, acrylic polymers, for example, polyacrylamides, polyvinylpyrrolidones, acrylic acid amide-acrylic acid ester copolymers, acrylic acid amide-acrylic acid ester-metharylic acid copolymers, styrene-maleic anhydride copolymer-alkali metal salts, isobutylene-maleic anhydride copolymer-alkali metal salts and casein; and latices of water-insoluble polymers, for example, polyvinyl acetates, polyurethanes, polyacrylic acids, polyacrylic acid esters, polybutyl methacrylates, styrene-butadiene copolymers, vinyl chloride-vinyl acetate copolymers, and styrene-butadiene-acrylic compound-copolymers. These additive may be added to a paper sheet-forming aqueous pulp slurry, or coated on or impregnated in the paper sheet.

Among the above-mentioned oxidized starches, dialdehyde starches produced by oxidizing starch with periodic acid has a high reactivity to cellulose and exhibits a high enhancing effect for dimensional stability of paper sheet, and thus is useful for the paper sheet for the substrate for the ink jet recording material of the present invention. Another cross-linking agent usable for the cellulose paper sheet may be selected from polyamide-epichlorohydrin resins, polyamide-epoxide resins, urea-formaldehyde resins and melamine-form aldehyde resins.

Particularly, the paper sheets for the substrate preferably contain at least one member selected from the dialdehyde starches and polyamide-epichlorohydrin resins, as a cross-linking agent.

When the paper sheet for the substrate is sized with the sizing agents, the sized paper sheet preferably exhibits a Stöckigt sizing degree of 25 to 150 seconds, more preferably 25 to 90 seconds, per 100 g/m$^2$ of the basis weight of the paper sheet, namely [(a real Stöckigt sizing degree)/(a real basis weight)]×100.

When the Stöckigt sizing degree per 100 g/m$^2$ of the basis weight is more than 150 seconds, the resultant paper sheet substrate may exhibit too low an ink-absorption capacity and, thus, in a printer, the resultant ink images on the recording sheet surface may blot, or may be kept undried over a long time and may stain devices or another recording material in the printer brought into contact with the undried ink images. Also, when the sizing degree is less than 25 seconds, the water contained in the aqueous ink images formed on the recording material may penetrate in a large amount into the paper sheet substrate and may cause the printed recording material to be cockled.

In the ink jet recording material of the present invention, the ink receiving layer comprises a xerogel porous pigment. The xerogel porous pigment can be produced by dispersing a pigment material in a liquid medium to form a sol, converting the sol to a gel in a solid state, removing the liquid medium from the gel by drying, and then usually pulverizing the dried gel into fine porous particles and classifying the fine porous particles. The xerogel porous pigment does not include precipitated porous pigments produced by a recrystallization method and calcined porous pigments, for example, a calcined kaolin pigment.

The xerogel porous pigments usable for the present invention are produced by, for example, the following known methods.

(1) A hydrogel is prepared from a hydrogel-forming substance, for example, aluminum hydroxide, alumina, silica or magnesium oxide, and dried to form a xerogel. The resultant xerogel is pulverized, and the resultant fine porous particles are classified by sieving.

(2) The hydrogel is granulated into a secondary or tertiary particle size, the resultant granules are dried and further heat-treated to calcin (oxidize) and/or crystallize, and to strengthen the bonding between primary particles of the resultant oxide pigment.

(3) A thermosetting resin, for example, a urea-formaldehyde resin or melamine-formaldehyde resin, is produced in an aqueous suspension of fine pigment particles, for example, colloidal silica and colloidal alumina particles. By controlling the resin-preparing conditions, the fine pigment particles are granulated into secondary fine particles having a desired secondary particle size. The secondary particle are dried. Optionally, the dried particles are calcined.

The xerogel pigment particles are available in trade.

Among the xerogel pigments, xerogel silica pigment has a relatively low index of refraction, and a high controllability in porous structure thereof, and thus exhibits a high ink-receiving property. Therefore, the xerogel silica pigment cause the resultant ink receiving layer to record the ink images having a high color density, and thus is useful for the present invention.

The ink receiving layer of the ink jet recording material of the present invention optionally contains, in addition to the xerogel porous pigment, an additional pigment comprising at least one member selected from non-xerogel inorganic pigments, for example, calcium carbonate, kaolin, calcined kaolin, talc, calcium sulfate, barium sulfate, titanium dioxide, zinc oxide, zinc carbonate, satin white, aluminum silicate, diatomaceous earth, calcium silicate, magnesium silicate, white carbon, and aluminum hydroxide; and non-xerogel organic pigments, for example, styrene polymers, acrylic resins, urea-formaldehyde resins, melamine-formaldehyde resins and benzoguanamine-formaldehyde resins.

The ink receiving layer usually further contains, a binder comprising at least one member selected from natural and semisynthetic polymers, for example, starch and starch derivatives, for example, oxidized starches, acetylated starches and starch urea-phosphates, cellulose derivatives, for example, carboxymethylcelluslose and hydroxyethylcellulose, casein, gelatin and soybean protein; and synthetic polymers, for example, polyvinyl alcohol and derivatives thereof, for example, cation-modified polyvinyl alcohols and silyl-modified polyvinyl alcohols, polyvinyl butyral resins, polyethyleneimine resins, polyvinyl pyrrolidone resins, poly(meth) acrylic acid resins, poly(meth) acrylate ester resins, polyamide resins, polyacrylamide resins, polyester resins, urea-formaldehyde resins, melamine-formaldehyde resins, styrene-butadiene copolymers, methyl methacrylate-butadiene copolymers, and other vinyl polymers, for example, ethylene-vinyl acetate copolymers. These polymers or resins may be modified with a cationic or anionic compound. These polymers or resins are preferably employed in the form of an aqueous solution, an aqueous emulsion or an aqueous dispersion.

Optionally, to enhance the water resistance of the ink images received in the ink receiving layer, the ink receiving layer further contains a cationic polymeric compound selected from, for example, polyethyleneimine resins, polyamine resins, polyamide resins, polyamide-epichlorohydrin resins, polyamine-epichlorohydrin resins, polyamidepolyamine-epichlorohydrin resins, polydiallylamine resins and dicyandiamide condensation products. Still further, the ink receiving layer optionally contains at least one additive selected from pigment-dispersing agents, thickening agents, anti-foaming agents, foam-suppressions, foaming agents, releasing agents, penetrating agents, wetting agents, thermogelatinizing agents, lubricants, etc, which are commonly used in the art.

There is no limitation to the coating amount of the ink receiving layer. The coating amount of the ink receiving layer is variable in response to the desired quality of the recorded ink images. When a high quality is required in the ink images, the ink jet recording material must have a high resistance to cockling. In this case, the ink receiving layer is preferably formed in a coating amount of 5 to 45 g/m$^2$, more preferably 12 to 40 g/m$^2$. When the amount of the ink receiving layer is less than 5 g/m$^2$, the resultant ink images recorded on the ink receiving layer may be unsatisfactory in clarity, precision, and reproducibility of the ink images. Also, when the coating amount is more than 45 g/m$^2$, the resultant ink images may be unsatisfactory in color density, and the resultant ink receiving layer may exhibit an insufficient surface strength.

In the ink jet recording material of the present invention, the ink receiving layer may have a single layer structure. However, the ink receiving layer preferably has a two or more-layered structure. In a preferred embodiment, the ink receiving layer has an under recording layer formed on the paper sheet substrate surface, and an upper recording layer formed on the under recording layer. Preferably, the xerogel porous pigment is contained, as a principal pigment component, in the upper recording layer. The xerogel porous pigment particles preferably have a BET specific surface area of 100 m$^2$/g or more. There is no specific upper limit to the BET specific surface area of the xerogel porous pigment particles. Usually, the xerogel porous pigment particles having a BET specific surface area of 1 to about 1,000 m$^2$/g are available in the trade. The under recording layer formed on the substrate surface preferably contains a non-xerogel pigment together with the xerogel porous pigment.

Preferably, the under recording layer comprises a mixed pigment comprising 25 to 75% by weight of xerogel porous pigment particles having a BET specific surface area of 100 m$^2$/g or more, more preferably 100 to 500 m$^2$/g, and 75 to 25% by weight of non-xerogel pigment particles having a BET specific surface area of 100 m$^2$/g or less, more preferably 60 m$^2$/g or less, still more preferably 50 m$^2$/g or less. When the content of the xerogel porous pigment in the mixed pigment contained in the under recording layer is less than 25% by weight, the resultant ink receiving layer may exhibit an unsatisfactory ink absorption capacity, and thus a portion of the liquid medium in the aqueous ink which cannot be held in the ink receiving layer may penetrate into and may be absorbed by the paper sheet substrate to cause the pulp fibers in the substrate to swell with the liquid medium of the ink, and the recorded recording material to be cockled. Otherwise, the non-held portion of the liquid medium of the printed ink may remain in the upper recording layer and may cause the ink images to blot and to exhibit a low quality. Also, the resultant ink receiving layer may exhibit an insufficient ink-absorption capacity and a reduced ink-absorbing rate, so as to cause the ink images on the ink jet recording materials to stain parts of the printer, for example, sheet-conveying rolls and the other ink jet recording materials. When the content of the xerogel porous pigment in the mixed pigment in the under recording layer is less than 25% by weight, the ink receiving layer must be formed in a significantly increased total coating amount, to remove the above-mentioned disadvantages. The large coating amount causes not only economical and operational disadvantages but also a reduced color density of the recorded ink images and a decreased surface strength of the ink receiving layer. Therefore, the increase in the coating amount of the ink receiving layer is not preferred. Also, when the content of the xerogel porous pigment is more than 75% by weight, while the resultant ink jet recording material exhibits a satisfactory resistance to cockling, the under recording layer may have a very high water-absorption property which causes the upper recording layer to exhibit a reduced water-retaining property. Thus, when the upper recording layer is coated on the under recording layer, undesirable streaks and scratches may be formed in the upper recording layer and the resultant upper recording layer may have a high unevenness and may exhibit an unsatisfactory appearance.

The non-xerogel pigment particles and the xerogel porous particles preferably have an average particle size of 0.3 to 15 $\mu$m, more preferably 1 to 10 $\mu$m.

The ink receiving layer can be formed on a surface of the paper sheet substrate by a conventional coating means, for example, sizepress machine, gate roll coater, roll coater, bar coater, air knife coater, rod blade coater, blade coater, die coater, and curtain coater. Particularly, the die coater and the curtain coater enable the coating amount of the coating liquid to be controlled before coating, and thus a selective absorption of a certain component of the coating liquid by the substrate or the under recording layer can be reduced. Also, when the die coater or the curtain coater is used, the resultant ink receiving layer has a uniform thickness, and thus the resultant ink images recorded on the ink receiving layer are satisfactory in uniformity.

When the paper sheet substrate is coated with a coating liquid, there is no limitation to a tension applied to the paper sheet substrate. Preferably, the tension for the substrate is 10 to 80 kg/m when the tension is less than 10 kg/m, the paper sheet substrate may slacken and thus the coating of the substrate may be effected unevenly. Also, when the tension is more than 80 kg/m, the high tension may cause formation of tensile wrinkles. Also, the orientation of the pulp fibers in the paper sheet substrate increases with increase in tension applied to the substrate, and the increase in the orientation causes the isotropy of the paper sheet substrate to increase, and thus the resultant ink jet recording material may exhibit a reduced resistance to cockling when ink jet-printed.

In the present invention, the ink jet recording material exhibits a limited water-dipping expansion of 0.3% or less, determined in accordance with the same testing method as the JAPAN TAPPI No. 27-B method, except that the length of the recording material immersed in water is measured 15 seconds after the start of the water immersion. When the water-dipping expansion is more than 0.3%, the resultant ink jet recording material exhibits poor resistance to cockling. Preferably, the ink jet recording material of the present invention exhibits a water-dipping expansion of 0.3% or less, determined 30 seconds after the start of the water immersion.

Generally, the paper sheet is anisotropic in the orientation of the pulp fibers from which the paper sheet is formed. Namely, in the machine direction (MD), the longitudinal direction of the paper sheet, the degree of orientation of the pulp fibers is higher than that in the cross machine direction (CD, the transverse direction). Therefore, the tensile strength of the paper sheet is higher in the MD than that in the CD. However, the tear strength and the water-dipping expansion of the paper sheet is higher in the CD than those in MD. In the present invention, the water-dipping expansion of the ink jet recording material is measured in a direction in which the recording material exhibit a highest water-dipping expansion, usually in the CD of the paper sheet substrate. In most of the ink jet recording materials, the orientation direction of the pulp fibers in the paper sheet substrate can be determined by naked eye observation of a person with ordinary skill in the art, and thus the CD of the recording material can be easily specified. However, if the CD of the recording material cannot be determined, for example, in the case where the back surface of the paper sheet substrate is coated with a back coating layer, and thus the CD of the paper sheet substrate cannot be recognized, the recording material is subjected to a water-dipping expansion determination test in which 6 water-dipping expansions of the recording material are measured at angle intervals of 30 degrees, and the water-dipping expansion of the recording material is represented by a highest value of the measured 6 water-dipping expansions. Usually, the value of the water-dipping expansion of the ink jet recording material increases with increase in the water-dipping time.

In the present invention, preferably the ink jet recording material exhibits a water-dipping expansion of 0.3% or less even when determined by the same method as the JAPAN TAPPI No. 27-B method, except that the measurement of the water-dipped recording material immersed in water is carried out 30 seconds after the start of the immersion in water.

In the JAPAN TAPPI No. 27-B method, the expansion of a paper sheet when dipped in water is determined by using a Fenchel expansion and shrinkage tester. In this determination, 5 specimens of the paper sheet are prepared each in a width of 15.0±0.2 mm and a length of about 150 mm. The water vessel of the tester was filled with water at a temperature of 20±2° C. The specimen was gripped at both the longitudinal ends thereof with a pair of upper and lower grips spaced 100 mm from each other, and the upper grip being connected to a load of a weight of about ¼ of the basis weight of the paper sheet. The gripped specimen is immersed in water in the water vessel. After the specimen is immersed in the water for a desired time, namely 15 seconds in the present invention, the length of the specimen immersed in water is measured.

The water-dipping expansion is calculated in accordance with the following equation.

$$Exp(\%)=\{(L_1-L_0)/L_0\}\times 100$$

wherein Exp represents the water-dipping expansion of the specimen in %, $L_1$ represent a measured length in mm of the water-immersed specimen and $L_0$ represents an original length of the specimen before immersion in water, namely about 100 mm.

Generally, the Canadian standard freeness (CSF) of a pulp represents a degree of beating applied to the pulp. When the beating degree is increased so as to decrease the freeness value, the resultant paper sheet exhibits an increased water-dipping expansion. Therefore, in the ink jet recording material of the present invention, the paper sheet substrate is preferably produced from a pulp having a proper freeness value which is not too small. In the paper sheet for the substrate, the degree of orientation of the pulp fibers is variable in response to the paper-forming conditions, especially a ratio of a jetting velocity of the aqueous pulp slurry through a head box to a forwarding velocity of a paper-forming wire net, namely a jet-wire (J/W) ratio, significantly contributes to controlling the pulp fiber orientation. Generally, the higher the orientation degree of the pulp fibers in the paper sheet, the larger the water-dipping expansion of the paper sheet. Therefore, the water-dipping expansion of the ink jet recording material can be controlled by controlling the jet-wire (J/W) ratio for the paper sheet substrate.

The bulk (apparent) density of the paper sheet substrate is not limited into a specific range. Preferably, the paper sheet substrate has a bulk density of 0.75 to 1.30 g/cm$^3$, more preferably 0.75 to 1.10 g/cm$^3$, still more preferably 0.85 to 1.10 g/cm$^3$, determined in accordance with Japanese Industrial Standard (JIS) P 8118. Where the paper sheet substrate has a bulk density of 0.75 to 1.3 g/cm$^3$, the resultant ink jet recording material exhibits a sufficient resistance to cockling and a satisfactory appearance. When the bulk density is less than 0.75 g/cm$^3$ the resultant ink jet recording material may exhibit an unsatisfactory resistant to cockling.

Also, when the bulk density is more than 1.3 g/cm$^3$, the resultant paper sheet has an increased transparency (a blackening phenomenon), and thus exhibits an unsatisfactory appearance. Accordingly, the bulk density of the paper sheet substrate should be controlled in consideration of the use purpose of the ink jet recording material.

Also when the paper sheet substrate, having the bulk density within the above-mentioned range, has a thickness of 100 $\mu$m or more, determined in accordance with JIS P 8118, the resultant ink jet recording material may exhibit a further enhanced resistance to cockling. However, if the thickness of the paper sheet is more than 300 $\mu$m, the resultant recording materials may not be smoothly fed into, forwarded through or delivered from the printer.

Accordingly, the paper sheet substrate usable for the ink jet recording materials of the present invention preferably has a bulk density of 0.75 to 1.30 g/cm$^3$ and a thickness of 100 to 300 $\mu$m, each determined in accordance with (JIS) P 8118. When the paper sheet substrate has the above-mentioned bulk density and thickness, the resultant ink jet recording material can exhibit a sufficient resistance to cockling, a satisfactory appearance and sufficient sheet-feeding aptitude for printer.

There is no limitation to a method of controlling the bulk density of the paper sheet for the substrate. Usually, the bulk density can be adjusted to a desired level by controlling the freeness (CSF)of the pulp for forming the paper sheet or applying a pressing treatment at room temperature or high temperature to the paper sheet by using a machine calender or super calender.

The ink jet recording material of the present invention preferably has a bulk density of 0.75 to 1.10 g/m$^3$ and a thickness of 100 $\mu$m to 300 $\mu$m.

The bulk density of 0.75 g/cm$^3$ or less determined in accordance with JIS P8118 causes the resultant recording material the exhibit a higher resistance to cockling than that of the bulk density of less than 0.75 g/cm$^3$. Also, when the bulk density is more than 1.10 g/cm$^3$, a blackening phenomenon (by which the transparency of the recording material increases) may occur, and thus this too high bulk density is not preferable under certain using conditions or for certain uses.

Also, even when the bulk density is within the above-mentioned range, the thickness of 100 $\mu$m or more causes the resultant recording material to exhibit a higher resistance to cockling than that of a thickness less than 100 $\mu$m. When the thickness is more than 300 $\mu$m, the feeding property of the recording material to the printer may be unstable. Therefore, the thickness of the recording material is preferably 100 $\mu$m or more but not more than 300 $\mu$m.

The ink jet recording material of the present invention is printed with an aqueous ink. The aqueous ink contains, as a dye, at least one member selected from water soluble direct dyes and water-soluble acid dyes. The aqueous ink optionally contains at least one additive selected from, for example, wetting agents, dye-dissolving agents, antiseptics and mildew-proofing agents.

The water-soluble direct dyes usable for the aqueous ink include CI. Direct Black 17, 19, 51, 71, 108 and 146, CI. Direct Yellow 12, 24, 26, 86, 98 and 142, CI. Direct Blue 6, 22, 25, 71, 86, 90, 106 and 199, CI. Direct Red 1, 4, 17, 28, and 83. Also, the water-soluble acid dyes include CI. Acid Black 2, 7, 24, 26, 31, 52, 63, 112 and 118, CI. Acid Yellow 11, 17, 23, 25, 29, 42, 61 and 71, CI. Acid Blue 9, 22, 40, 59, 93, 102, 104, 117, 229 and 234, and CI. Acid Red 6, 32, 37, 51, 92, 115 and 315. However, the water-soluble dyes usable for the aqueous ink are not limited to the above-mentioned dyes.

EXAMPLES

The present invention will be further explained by the following examples which are merely representative and do not limit the scope of the present invention in any way.

In the examples and comparative examples, "part" and "%" mean "part by weight" and "% by weight", respectively.

In Examples I-1 to I-6 and Comparative Examples I-1 to I-2, the following tests are applied to the resultant ink jet recording materials. (1) Water-Dipping Expansion The water-dipping expansion of each ink jet recording material was determined by the same method as the JAPAN TAPPI No. 27-B method, except that the length of the water-immersed recording sheet specimen was measured 15 seconds or 30 seconds after the start of the immersion in water.

(2) Color Density of Recorded Ink Image

Each ink jet recording material was printed at a recording density of 720 dpi by using an Ink Jet Printer PM-700C, made by SEIKO EPSON CO. and the color density of the recorded ink images was determined. The measurement results are ranked into the following three classes.

| Class | Color Density |
|---|---|
| A | Excellent |
| B | Satisfactory in practice |
| C | Unsatisfactory in practice |

(3) Resistance to Ink Penetration to Back Face of Recording Material

Each ink jet recording material was printed at a recording density of 720 dpi by the Ink Jet Printer PM-700C (made by SEIKO EPSON CO.) to form ink images having a color density of 100%. The printed recording material was observed by naked eye at the back face of the recording material. The degree of resistance to penetration of the ink to the back face of the recording material was ranked into the following three classes.

| Class | Ink Penetration |
|---|---|
| A | Substantially no ink images are recognized at the back face. |
| B | Ink images are slightly recognized at the back face, but are satisfactory in practice. |
| C | Ink images are clearly recognized at the back face, and are unsatisfactory in practice. |

(4) Resistance to Cockling

Each ink jet recording material was printed at a recording density of 720 dpi by using the Ink Jet Printer MP-700C (made by SEIKO EPSON CO.) to form ink images having a color density of 200%, and the cockling phenomenon on the printed recording material was checked by naked eye. The check results are ranked into the following four classes.

| Class | Cockling |
|---|---|
| A | Substantially no cockling occurs |
| B | Slight cockling occurs, and is satisfactory for practical ink jet printing with high clarity and precision of ink images |
| C | Certain cockling occurs, but is usable for practical printing with a high clarity and precision |
| D | Clear cockling occurs, and is non-usable for practical printing |

Example I-1

An aqueous pulp slurry was prepared from 80 parts of LBKP having a CSF of 490 ml, 20 parts of LBKP having a CSF of 470 ml, a filler comprising 2 parts of ground calcium carbonate, 1.5 parts of a modified rosin, 2.0 parts of dialdehyde starch, and 0.5 part of aluminum sulfate, and 4 parts of a cross-linking agent consisting of a polyamide-epichlorohydrin resin, and subjected to a paper-forming procedures using a wire paper machine. The resultant wood-free paper sheet having a basis weight of 80 g/m$^2$ was size-pressed with a surface sizepress liquid containing 4.0% of a completely saponified polyvinyl alcohol and 0.5% of a modified rosin. The amount of the sizepress liquid cohered to the paper sheet was 30 ml/m$^2$. The resultant sizepressed paper sheet had an ash content of 2.0% and was used as a paper sheet for substrate.

The paper sheet for substrate had a Stöckigt sizing degree of 48 seconds per 100 g/m$^2$ of the basis weight.

A front surface of the paper sheet was coated with an ink receiving layer-forming liquid prepared by mixing an aqueous dispersion prepared by dispersing 100 parts of an amorphous silica pigment having a BET specific surface area of 260 m$^2$/g of an average particle size of 2.8 $\mu$m (trademark: FINESIL X-37, made by TOKUYAMA K.K.), in 500 parts of a 10% aqueous solution of a cationic resin (trademark: UNISENCE CP-103, made by SENCA KOGYO K.K.) with 250 parts of a 10% aqueous solution of a binder consisting of a silyl-modified polyvinyl alcohol (trademark: KURARAY POVAL R-1130, made by K.K. KURARAY), under a tension of 30 kg/m applied to the paper sheet substrate, to form an ink receiving layer having a dry weight of 20 g/m$^2$ on the paper sheet substrate. The coated paper sheet was calendered by using a super calender under a linear pressure of 50 kg/cm at a sheet-forwarding speed of 5 m/min, to produce an ink jet recording material.

The test results of the resultant ink jet recording material are shown in Table 1.

Example I-2

A front surface of the same paper sheet for substrate as in Example I-1 was coated with a first coating liquid prepared by mixing an aqueous dispersion prepared by dispersing 70 parts of a calcined kaolin (trademark: Ansilex, made by Engelhard Co., and having a BET specific surface area of 15 m$^2$/g and an average particle size of 0.6 $\mu$m) and 30 parts of an amorphous silica pigment (trademark: Mizukasil P-78D, made by MIZUSAWA KAGAKU KOGYO K.K.) and having a BET specific surface area of 370 m$^2$/g and an average particle size of 8 $\mu$m) with 50 parts of a 10% aqueous solution of a polyvinyl alcohol (trademark: PVA 110, made by K.K. Kuraray) and 10 parts of a 48% latex (trademark: L-1537, made by ASAHI KASEI KOGYO K.K.), and having a solid concentration of 35%, by using a Mayer bar, and is dried to form an under recording layer having a dry amount of 10 g/m$^2$.

The surface of the under recording layer is coated with a second coating liquid prepared by dispersing 100 parts of an amorphous silica (trademark: FINESILX-60, made by K.K. TOKUYAMA), and having a BET specific surface area of 300 m$^2$/g and an average particle size of 6.2 $\mu$m in 200 parts of a 10% aqueous solution of a silyl-modified polyvinyl alcohol (trademark: KURARAY POVAL R-1130, made by K.K. KURARAY) and mixing the resultant dispersion with 40 parts of a cationic resin (trademark: UNISENCE CP-103, made by SENCA KOGYO K.K.) and 30 parts of a latex (trademark: YODOSOL CE-58, made by NIPPON NSC K.K.), and having a solid content of 20%, by using a Mayer bar, and is dried to form an upper recording layer having a dry amount of 15 g/m$^2$.

A two layered ink receiving layer was formed on the paper sheet substrates. The coating procedures with the first coating liquid or the second coating liquid were carried out under a tension of 30 kg/m applied to the paper sheet substrate or to the under recording layer coated paper sheet substrate.

The resultant coated sheet was calendered by a supper calender in the same manner as in Example I-1.

A ink jet recording material having the two layered ink receiving material was obtained.

The test results are shown in Table 1.

Example I-3

An ink jet recording material was produced by the same procedures as in Example I-2 with the following exceptions.

The paper sheet for the substrate had a basis weight of 120 g/m$^2$, and a Stöckigt sizing number of 55 seconds per 100 g/m$^2$ of the basis weight.

The test results are shown in Table 1.

Example I-4

An ink jet recording material was produced by the same procedures as in Example I-3, with the following exceptions.

In the production of the paper sheet for the substrate, the surface sizing liquid contained the modified resin in an amount of 1.8 parts.

The paper sheet had a Stöckigt sizing number of 73 seconds per 100 g/m$^2$ of the basis weight.

Example I-5

An ink jet recording material was produced by the same procedures as in Example I-4 with the following exceptions.

The paper sheet for the substrate had a basis weight of 80 g/m$^2$, and a Stöckigt sizing number of 68 seconds per 100 g/m$^2$ of the basis weight.

The test results are shown in Table 1.

Example I-6

An ink jet recording material was produced by the same procedures as in Example I-5 with the following exceptions.

In the coating of each of the first and second coating liquids, the tension applied to the paper sheet substrate was 60 Kg/m.

The test results are shown in Table 1.

Comparative Example I-1

An aqueous pulp slurry was prepared from 80 parts of LBKP having a CSF of 490 ml, 20 parts of LBKP having a CSF of 470 ml, a filter comprising 12 parts of calcined kaolin and 0.2 part or a modified rosin, and subjected to a paper-forming procedures using a wire paper machine. The resultant woodfree paper sheet having a basis weight of 80 g/m$^2$ was size-pressed with a surface sizepress liquid containing 2.0% of a—modified starch. The amount of the sizepress liquid cohered to the paper sheet was 40 ml/m$^2$. The resultant sizepressed paper sheet had an ash content of 9.0% and a Stöckigt sizing degree of 10 seconds per 100 g/m$^2$ of the basis weight, and was used as paper sheet for substrate.

A front surface of the paper sheet was coated with an ink receiving layer-forming liquid prepared by mixing an aqueous dispersion prepared by dispersing 100 parts of an amorphous silica pigment having a BET specific surface area of 260 m$^2$/g and an average particle size of 2.8 $\mu$m (trademark: FINESIL X-37, made by TOKUYAMA K.K.) in 500 parts of a 10% aqueous solution of a cationic resin (trademark: UNISENCE CP-103, made by SENCA KOGYO K.K.) with 250 parts of a 10% aqueous solution of a binder consisting of a silyl-modified polyvinyl alcohol (trademark: KURARAY POVAL R-1130, made by K.K. KURARAY), under a tension of 30 kg/m applied to the paper sheet substrate, to form an ink receiving layer having a dry weight of 20 g/m$^2$ on the paper sheet substrate. The coated paper sheet was calendered by using a super calender under a linear pressure of 50 kg/cm at a sheet-forwarding speed of 5 m/min, to produce an ink jet recording material.

The test results of the resultant ink jet recording material are shown in Table 1.

Comparative Example I-2

An ink jet recording material was produced by the same procedures as in Example I-2, except that, in each of the coating procedures of the first and second coating liquids, the tension applied to the paper sheet substrate was 60 kg/m.

The test results are shown in Table 1.

TABLE 1

| | | Item | | | | | | | | | | |
|---|---|---|---|---|---|---|---|---|---|---|---|---|
| | | Paper sheet substrate | | Ink jet recording material | | | | | | | | |
| | | | | | | Color | | Resistance | Water-dipping expansion (%) | | | |
| | | | Bulk | | | density | Resistance | to ink | Water immersion time | | | |
| | | Thickness | density | Thickness | Bulk Density | of ink | to | penetration into | 15 seconds | | 30 seconds | |
| Example No. | | ($\mu$m) | (g/cm$^3$) | ($\mu$m) | (g/cm$^3$) | images | cockling | back face | MD | CD | MD | CD |
| Example | I-1 | 82 | 0.97 | 109 | 0.92 | A | C | B | 0.07 | 0.20 | 0.08 | 0.35 |
| | I-2 | 82 | 0.97 | 111 | 0.95 | A | C | B | 0.07 | 0.22 | 0.08 | 0.37 |
| | I-3 | 123 | 0.97 | 150 | 0.97 | A | B | A | 0.07 | 0.21 | 0.09 | 0.33 |
| | I-4 | 123 | 0.97 | 150 | 0.97 | A | A | A | 0.08 | 0.15 | 0.10 | 0.22 |
| | I-5 | 84 | 0.95 | 113 | 0.93 | A | B | B | 0.08 | 0.18 | 0.10 | 0.28 |
| | I-6 | 84 | 0.95 | 113 | 0.93 | A | C | B | 0.04 | 0.25 | 0.08 | 0.36 |
| Comparative | I-1 | 102 | 0.78 | 139 | 0.72 | A | D | B | 0.06 | 0.38 | 0.06 | 0.42 |
| Example | I-2 | 82 | 0.97 | 109 | 0.96 | A | D | B | 0.05 | 0.32 | 0.07 | 0.40 |

Note:
MD . . . Machine direction
CD . . . Cross machine direction

In view of Table 1, it is clear that the ink jet recording materials of Examples I-1 to I-6 in accordance with the present invention had water-dipping expansions of lower than 0.3% both in the longitudinal and transverse directions (MD and CD), and thus exhibited excellent color density of the recorded ink images, resistance to ink penetration into the back face of the recording material and resistance to cockling.

Also, it was confirmed that the ink jet recording materials of Examples I-1 to I-6 had a high ink-drying property and an excellent resistance to ink-blotting.

In Examples II-1 to II-8 and Comparative Examples II-1, the resultant ink jet recording materials are subjected to the following tests.

(1) Water-Dipping Expansion

The water-dipping expansion of each ink jet recording material was determined by the same method as JAPAN TAPPI No. 27-B method, except that the length of the water-immersed recording sheet specimen was measured 15 seconds after the start of the immersion in water.

(2) Color Density of Recorded Ink Image

Each ink jet recording material was printed at a recording density of 720 dpi by using an Ink Jet Printer PM-700C, made by SEIKO EPSON CO., and the color density of the recorded ink images was determined. The measurement results are ranked into the following three classes.

| Class | Color Density |
|---|---|
| A | Excellent |
| B | Satisfactory in practice |
| C | Unsatisfactory in practice |

(3) Resistance of Ink Images to Blotting

Each ink jet recording material was printed at a recording density of 720 dpi and with a color density of 200% of ink images, by using an Ink Jet Printer PM-700C, made by SEIKO EPSON CO., and the blotting of the ink images received on the recording material was checked by the naked eye. The check results are ranked into the following three classes.

| Class | Ink-blotting |
|---|---|
| A | Substantially no blotting |
| B | Slight blotting, but satisfactory in practice |
| C | Significant blotting and unsatisfactory in practice |

(4) Resistance to Cockling

Each ink jet recording material was printed at a recording density of 720 dpi by using the Ink Jet Printer PM-700C (made by SEIKO EPSON CO.) to form ink images having a color density of 200%, and the cockling phenomenon on the printed recording material was checked by the naked eye. The check results are ranked into the following three classes.

| Class | Cockling |
|---|---|
| A | No cockling occurs |
| B | Slight cockling, but satisfactory for pactical ink jet printing |
| C | Clear cockling, and non-usable for practical printing |

(5) Resistance to Ink Penetration to Back Face of Recording Material

Each ink jet recording material was printed at a recording density of 720 dpi by the Ink Jet Printer PM-700C (made by SEIKO EPSON CO.) to form ink images having a color density of 200%. The printed recording material was observed by the naked eye at the back face of the recording material. The degree of resistance to penetration of the ink to the back face of the recording material was ranked into the following three classes.

| Class | Ink penetration |
|---|---|
| A | No ink images are recognized at the back face. |
| B | Ink images are slightly recognized at the back face. |
| C | Ink images penetrate to the back face, but are usable in practice. |
| D | Ink images badly penetrates to the back face and are not usable for practice |

Example II-1

An aqueous pulp slurry was prepared from 80 parts of LBKP having a CSF of 490 ml, 20 parts of LBKP having a CSF of 470 ml, a filler comprising 3 parts of talc, 1.5 parts of a modified rosin, 2.0 parts of dialdehyde starch, and 0.5 part of aluminum sulfate, and 4 parts of a polyamide-epichlorohydrin resin, and subjected to a paper-forming procedures using a wire paper machine. The resultant wood-free paper sheet was size-pressed with a surface sizepress liquid containing 4.0% of a completely saponified polyvinyl alcohol and 0.5% of a modified rosin. The amount of the sizepress liquid cohered to the paper sheet was 30 ml/m$^2$. The resultant sizepressed paper sheet had a basis weight of 100 g/m$^2$ and an ash content of 2.0%. The size pressed paper sheet was used as paper sheet for substrate.

The paper sheet for substrate had a Stöckigt sizing degree as shown in Table 2 per 100 g/m$^2$ of the basis weight.

A front surface of the paper sheet was coated with a first coating liquid prepared by mixing an aqueous dispersion prepared by dispersing 100 parts of an amorphous silica pigment (trademark: FINESIL X-37, made by TOKUYAMA K.K., and having a BET specific surface area of 260 m$^2$/g and an average particle size of 2.8 $\mu$m in 500 parts of a 10% aqueous solution of a cationic resin (trademark: UNISENCE CP-103, made by SENCA KOGYO K.K.) with 250 parts of a 10% aqueous solution of a binder consisting of a silyl-modified polyvinyl alcohol (trademark: KURARAY POVAL R-1130, made by K.K. KURARAY), by using a Mayer bar under a tension of 30 kg/m applied to the paper sheet substrate, and then dried to form an under recording layer having a dry weight of 10 g/m$^2$ on the paper sheet substrate.

The surface of the under recording layer was coated with an upper recording layer, by the same procedures as the under recording layer-forming procedures, except that the dry amount of the resultant upper recording layer was 15 g/m. A two-layered ink receiving layer was obtained in a dry amount of 25 g/m$^2$.

The coated paper sheet was calendered by using a super calender under a linear pressure of 50 kg/cm at a sheet-forwarding speed of 5 m/min, to produce an ink jet recording material.

The test results of the resultant ink jet recording material are shown in Table 2.

Example II-2

A front surface of the same paper sheet for substrate in Example II-1 was coated with a first coating liquid having a solid concentration of 30% and prepared by dispersing 70 parts of calcined kaolin pigment (trademark: Ansilex, made by Englhard Co., and having a BET specific surface area of 15 m$^2$/g and an average particle size of 0.6 $\mu$m, and 30 parts of an amorphous silica pigment (trademark: MIZUKASIL P-78D, made by MIZUSAWA KAGAKU KOGYO K.K., and having a BET specific surface area of 370 m$^2$/g and an average particle size of 8 $\mu$m, in 300 parts of water, and mixing the resultant aqueous dispersion with 50 parts of a 10% aqueous solution of a polyvinyl alcohol (trademark: KURARAY POVAL 110, made by K.K. KURARY) and 10 parts of a 48% polyacrylate ester resin latex (trademark: L-1537, made by ASAHI KASEIKOGYO K.K.), by using a Mayer bar, and then dried, to form an under recording layer having a dry amount of 10 g/m$^2$ on the paper sheet substrate.

The resultant under recording layer surface was coated with a second coating liquid having a solid concentration of 20% and prepared by dispersing 100 parts of amorphous silica pigment (trademark: FINESIL X-60, made by K.K. TOKUYAMA, and having a BET specific surface area of 300 m$^2$/g and an average particle size of 6.2 $\mu$m in water, and mixing the resultant aqueous dispersion with 200 parts of a 10% aqueous solution of a modified polyvinyl alcohol (trademark: KURARAY POVAL R-1130, made by K.K. KURARAY), 40 parts of a cationic resin (trademark: UNISENCE CP-103, made by SENCA KOGYO K.K.) and 30 parts of an ethylene-vinyl acetate copolymer resin latex (trademark: YODOSOL CE-58, made by NIPPON NSC K.K.), by using a Mayer bar, and then dried to form an upper recording layer having a dry amount of 15 g/m$^2$ on the under recording layer. A two layered ink receiving layer with a dry amount of 25 g/m$^2$ was obtained.

The coated paper sheet was calendered by the same procedures as in Example II-1, to produce an ink jet recording material.

In the coating procedures with the first and second coating liquids, the paper sheet substrate and the first recording layer-coated substrate were coated under a tension of 30 g per m of the width thereof.

The test results are shown in Table 2.

Example II-3

An ink jet recording material was produced by the same procedures as in Example II-2 with the following exceptions.

In the aqueous pulp slurry for forming the paper sheet for the substrate, the content of the modified rosin was 1.0 part, and the surface sizing liquid contained 4.0% of oxidation-modified starch alone.

The test results are shown in Table 1.

Example II-4

An ink jet recording material was produced by the same procedures as in Example II-2, with the following exception.

In the aqueous pulp slurry for the paper sheet for the substrate, the content of the modified rosin was 2.5 parts.

The test results are shown in Table 2.

Example II-5

An ink jet recording material was produced by the same procedures as in Example II-2, with the following exception.

In the coating procedures of the first and second coating liquids, the paper sheet substrate and the under printing layer-coated substrate were tensed under tension of 70 kg/m.

The test results are shown in Table 2.

Example II-6

An ink jet recording material was produced by the same procedures as in Example II-2, except that no calender treatment was applied to the ink receiving layer-coated sheet.

The test results are shown in Table 2.

Example II-7

An ink jet recording material was produced by the same procedures as in Example II-2, except that the super calender treatment was repeatedly carried out under a linear pressure of 200 kg/cm at a sheet-forwarding speed of 5 m/minutes and repeated four times.

The test results are shown in Table 2.

Comparative Example II-1

An aqueous pulp slurry was prepared from 80 parts of LBKP having a CSF of 490 ml, 20 parts of LBKP having a CSF of 470 ml, a filler comprising 12 parts of calcined kaolin, 0.2 part of a modified rosin, and 0.3 part of aluminum sulfate. The aqueous pulp slurry was subjected to a paper-forming procedure using a wire paper machine. The resultant paper sheet was sized with 30 ml/m$^2$ of a surface-sizing liquid containing 4.0% of an oxidized starch alone.

The resultant sized paper sheet for a substrate had a basis weight of 100 g/m$^2$ and an ash content of 9.0%.

A front surface of the paper sheet substrate was coated with the same ink receiving layer-forming liquid as in Example II-1 by the same procedures as in Example II-1, and then coated substrate was calendered by the same super calender in the same manner as in Example II-1.

The test results are shown in Table 2.

Example II-8

An aqueous pulp slurry was prepared from 80 parts of LBKP having a CSF of 490 ml, 20 parts of NBKP having a CSF of 470 ml, a filler comprising 3 parts of talc, 3.0 parts of a modified rosin, 2.0 parts of dialdehyde starch, and 0.8 part of aluminum sulfate, and 6 parts of a polyamide-epichlorohydrin resin. The aqueous pulp slurry was subjected to a paper-forming procedures using a wire paper machine. The resultant woodfree paper sheet was size-pressed with 30 ml/m$^2$ of a surface sizepress liquid containing 4.0% of a completely saponified polyvinyl alcohol and 0.7% of a modified rosin. The resultant sizepressed paper sheet had a basis weight of 100 g/m$^2$ and an ash content of 2.0%. The size pressed paper sheet was used as paper sheet for substrate.

The paper sheet for substrate had the Stöckigt sizing degree as shown in Table 2, per 100 g/m$^2$ of the basis weight.

A front surface of the paper sheet was coated with the same two layered ink receiving layer as in Example II-1 by the same procedures as in Example II-1. The resultant coated sheet was super calender-treated by the same procedures as in Example II-1.

The test results are shown in Table 2.

Comparative Example II-2

An ink jet recording material was produced by the same coating and calendering procedures as in Example II-1, except that the same paper sheet substrate as in Comparative Example II-1 was directly coated with the same second coating liquid as in Example II-1, and the resultant coating layer was in a dry weight of 15 g/m$^2$.

The test results are shown in Table 2.

TABLE 2

| | | Item | | | | | | | |
|---|---|---|---|---|---|---|---|---|---|
| | | Stöckigt | Ink jet recording material | | | | | | |
| Example No. | | sizing degree of paper sheet substrate | Color density of ink images | Resistance to blotting | Resistance to cockling | Resistance to ink penetration | Water-dipping expansion | Thickness ($\mu$m) | Bulk Density (g/cm$^3$) |
| Example | II-1 | 70 | B | A | A | A | 0.18 | 142 | 0.88 |
| | II-2 | 70 | A | A | A | A | 0.20 | 142 | 0.88 |
| | II-3 | 32 | A | A | A | A | 0.25 | 142 | 0.88 |
| | II-4 | 140 | A | A | A | A | 0.15 | 142 | 0.88 |
| | II-5 | 70 | A | A | A | A | 0.26 | 142 | 0.88 |
| | II-6 | 70 | A | A | B | A | 0.19 | 171 | 0.73 |
| | II-7 | 70 | A | A | A | B | 0.23 | 116 | 1.08 |
| Comparative Example | II-1 | 20 | B | A | B | D | 0.42 | 142 | 0.88 |
| Example | II-8 | 220 | A | B | A | A | 0.13 | 142 | 0.88 |
| Comparative Example | II-2 | 20 | B | A | C | D | 0.42 | 142 | 0.88 |

Table 2 clearly shows that the ink jet recording materials of Examples II-1 to II-8 in accordance with the present invention had satisfactory water-dipping elongation, thickness and bulk density and thus exhibited excellent color density of printed ink images, ink image-drying property resistance to ink blotting, resistance to cockling, and resistance to ink penetration into the back face.

In Examples III-1 to III-9, the resultant ink jet recording materials are subjected to the following tests.

(1) Water-Dipping Expansion

The water-dipping expansion of each ink jet recording material was determined in the transverse direction (CD) thereof by the same method as JAPAN TAPPI No. 27-B method, except that the length of the water-immersed recording sheet specimen was measured 15 seconds after the start of the immersion in water.

(2) Color Density of Recorded Ink Image

Each ink jet recording material was printed at a recording density of 720 dpi by using an Ink Jet Printer PM-700C, made by SEIKO EPSPON CO., and the color density of the recorded ink images was determined. The measurement results are ranked into the following three classes.

| Class | Color Density |
|---|---|
| A | Excellent |
| B | Satisfactory in practice |
| C | Unsatisfactory in practice |

(3) Drying Property of Ink Images

Each ink jet recording material was printed by the Ink Jet Printer PM-700C (made by SEIKO EPSON CO.) at a recording density of 720 dpi to form ink images having a color density of 100%. The time between a stage at which the printed recording material is delivered from the printer and a stage at which the gloss of the ink images was lost was checked by the naked eye. The drying property of the ink images are ranked into the following three classes.

| Class | Drying property |
|---|---|
| A | Ink images gloss is lost within a time of less than 10 seconds after the printed sheet is delivered from the printer. |
| B | Ink image gloss is retained for a time of more than 10 seconds but not more than 2 minutes after the printed sheet is delivered from the printer, and is usable in practice. |
| C | Ink image gloss is retained for two minutes or more after the printed sheet is delivered from the printer, and is insuitable for practice. |

(4) Resistance of Ink Images to Blotting

Each ink jet recording material was printed at a recording density of 720 dpi and with a color density of 200% of ink images, by using an Ink Jet Printer PM-700C, made by SEIKO EPSON CO., and the blotting of the ink images received on the recording material was checked by the naked eye. The check results are ranked into the following three classes.

| Class | Ink-blotting |
|---|---|
| A | Substantially no blotting |
| B | Slightly blotting |
| C | Blotting occurs but usable in practice |
| D | Significantly blotting occurs and the blotted ink images are not readable in practice |

(5) Resistance to Cockling

Each ink jet recording material was printed at a recording density of 720 dpi by using the Ink Jet Printer PM-700C (made by SEIKO EPSON CO.) to form ink images having a color density of 200%, and the cockling phenomenon on the printed recording material was checked by naked eye. The check results are ranked into the following three classes.

| Class | Cockling |
|---|---|
| A | Substantially no cockling occurs |
| B | Slight cockling occurs, but satisfactory for practical ink jet printing |
| C | Clear cockling occurs, and unsuitable for practical printing |

(6) Ink Penetration to Back Face of Recording Material

Each ink jet recording material was printed at a recording density of 720 dpi by the Ink Jet Printer PM-700C (made by SEIKO EPSON CO.) to form ink images having a color density of 200%. The printed recording material was observed by naked eye at the back face of the recording material. The degree of penetration of the ink to the back face of the recording material was ranked into the following three classes.

| Class | Ink penetration |
|---|---|
| A | Substantially no ink images are recognized at the back face. |
| B | Ink images are slightly recognized at the back face, but satisfactory in practice. |
| C | Ink images are clearly recognized at the back face, and unsatisfactory in practice. |

Example III-1

A woodfree paper sheet having a thickness of 150 $\mu$m, a bulk density of 0.96 g/cm$^3$ and a basis weight of 144 g/m$^2$ was prepared from an aqueous pulp slurry containing 100 parts of a hardwood pulp, 1 part of an alkylketene dimer, 0.5 part of aluminum sulfate and 2 parts of a cationized starch by a wire paper machine. The paper sheet had a Stöckigt sizing degree of 60 seconds per 100 g/m$^2$ of basis weight.

A front surface of the paper sheet was coated, by using a Mayer bar, with a first coating liquid having the composition (1) shown below and dried to form an under recording layer in a dry amount of 9 g/m$^2$, and then the surface of the under recording layer was coated, by using a Mayer bar, with a second coating liquid having the composition (2) shown below and dried to form an upper recording layer in a dry amount of 13 g/m$^2$.

A two-layered ink receiving layer in a total amount of 22 g/m$^2$ was formed on the paper sheet substrate, and thus an ink jet recording material was obtained.

The test results are shown in Table 3.

| Composition (1) for the under recording layer | |
|---|---|
| Component | Part |
| Calcium carbonate $(*)_1$ | 30 |
| Amorphous silica $(*)_2$ | 70 |

-continued

Composition (1) for the under recording layer

| Component | Part |
|---|---|
| Polyvinyl alcohol $(*)_3$ | 5 |
| SBR latex $(*)_4$ | 10 |

Note:
$(*)_1$ . . . Trademark: BRILLIANT - 15, made by SHIRAISHI CALCIUM K.K. and having a specific surface area of 11.9 $m^2/g$
$(*)_2$ . . . Trademark: FINESIL X-37, made by K.K. TOKUYAMA, and having a specific surface area of 260 $m^2/g$
$(*)_3$ . . . Trademark: PVA 117, made by K.K. KURARAY
$(*)_4$ . . . Trademark: JS R0617, made by ASAHI KASEI KOGYO K.K.

Composition (2) for the under recording layer

| Component | Part |
|---|---|
| Amorphous silica $(*)_2$ | 100 |
| Silyl-modified polyvinyl alcohol $(*)_5$ | 20 |
| Cationic resin $(*)_6$ | 5 |

Note:
$(*)_5$ . . . Trademark: R-1130, made by K.K. KURARAY
$(*)_6$ . . . Trademark: PAS-H-5L, made by NITTO BOSEKI K.K. and comprising polydiallyldimethyl ammonium chloride

Example III-2

An ink jet recording material was produced by the same procedures as in Example III-1, except that in the composition (1) for the under recording layer, the content of the calcium carbonate was 50 parts and the content of the amorphous silica was 50 parts.

The test results are shown in Table 3.

Example III-3

An ink jet recording material was produced by the same procedures as in Example III-1, except that in the composition (1) for the under recording layer, the content of the calcium carbonate was 70 parts and the content of the amorphous silica was 30 parts.

The test results are shown in Table 3.

Example III-4

An ink jet recording material was produced by the same procedures as in Example III-1, except that in the composition (1) for the under recording layer, the content of the calcium carbonate was 80 parts and the content of the amorphous silica was 20 parts.

The test results are shown in Table 3.

Example III-5

An ink jet recording material was produced by the same procedures as in Example III-1, except that in the composition (1) for the under recording layer was replaced by the composition (3) shown below.

Composition (3) for the under recording layer

| Component | Part |
|---|---|
| Calcium carbonate $(*)_7$ | 80 |
| Amorphous silica $(*)_2$ | 20 |

-continued

Composition (3) for the under recording layer

| Component | Part |
|---|---|
| Polyvinyl alcohol $(*)_3$ | 5 |
| SBR latex $(*)_4$ | 10 |

Note:
$(*)_7$ . . . Trademark: CALRITE KT, made by SHIRAISHI CALCIUM K.K., specific surface area: 31.4 $m^2g$

Example III-6

An ink jet recording material was produced by the same procedures as in Example III-1, except that in the composition (1) for the under recording layer was replaced by the composition (4) shown below.

Composition (4) for the under recording layer

| Component | Part |
|---|---|
| Calcined Kaolin $(*)_8$ | 30 |
| Amorphous silica $(*)_9$ | 70 |
| Polyvinyl alcohol $(*)_3$ | 5 |
| SBR latex $(*)_4$ | 10 |

Note:
$(*)_8$ . . . Trademark: Ansilex, made by Englhard, and having a specific surface area of 15.3 $m^2g$.
$(*)_9$ . . . Trademark: Caplex FPS-101, made by SHIONOGI SEIYAKU K.K., having a specific surface area of 260 $m^2/g$.

The test results are shown in Table 3.

Example III-7

An ink jet recording material was produced by the same procedures as in Example III-6, except that in the composition (4) for the under recording layer, the content of the calcined kaolin was 20 parts and the content of the amorphous silica was 80 parts.

The test results are shown in Table 3.

Example III-8

An ink jet recording material was produced by the same procedures as in Example III-6, except that in the composition (4) for the under recording layer, the content of the calcined kaolin was 80 parts and the content of the amorphous silica was 20 parts.

Example III-9

An ink jet recording material was produced by the same procedures as in Example III-1, except that in the composition (1) for the under recording layer was replaced by the composition (5) shown below.

Composition (5) for the under recording layer

| Component | Part |
|---|---|
| Calcium carbonate $(*)_1$ | 30 |
| Amorphous silica $(*)_{10}$ | 70 |
| Polyvinyl alcohol $(*)_3$ | 5 |
| SBR latex $(*)_4$ | 10 |

Note:
$(*)_{10}$ . . . Trademark: SYLICIA 770, made by FUJI SILICIA KAGAKU K.K., and having a specific surface area of 700 $m^2g$.

The test results are shown in Table 3.

TABLE 3

| Example No. | | Item | | | | | |
|---|---|---|---|---|---|---|---|
| | | Color density of ink images | Ink-drying property | Resistance to ink-blotting | Resistance to cockling | Resistance to ink penetration | Water-dipping expansion in CD (%) |
| Example | III-1 | A | A | A | A | A | 0.2 |
| | III-2 | A | A | A | A | A | 0.2 |
| | III-3 | A | A | A | A | A | 0.2 |
| | III-4 | A | B | C | B | A | 0.2 |
| | III-5 | A | B | B | B | A | 0.2 |
| | III-6 | A | A | A | A | A | 0.2 |
| | III-7 | A | A | A | B | A | 0.2 |
| | III-8 | A | B | B | B | A | 0.2 |
| | III-9 | A | A | B | A | A | 0.2 |

What is claimed is:

1. An ink jet recording material comprising a paper sheet substrate; and an under recording layer coated on the paper sheet substrate and comprising a mixed pigment comprising 25 to 75% by weight of a xerogel silica porous pigment in the form of fine particles having a BET specific surface area of 100 $m^2/g$ or more and 75 and 25% by weight of a non-xerogel calcium carbonate pigment in the form of particles having a BET specific surface area of 100 $m^2/g$ or less, and a binder; and an upper recording layer coated on the under recording layer and comprising a pigment consisting of xerogel silica porous pigment particles and a binder, the ink jet recording material exhibiting a water-dripping expansion of 0.3% or less, determined in accordance with the same method as the JAPAN TAPPI No. 27-B method, except that the length of the recording material immersed in water is measured 15 seconds after the start of the immersion.

2. The ink jet recording material as claimed in claim 1, wherein the water-dipping expansion of the recording material is 0.3% or less determined in accordance with JAPAN TAPPI No. 27-B, except that the length of the recording material immersed in water is measured 30 seconds after the start of the immersion.

3. The ink jet recording material as claimed in claim 1, wherein the paper sheet substrate has a Stöckigt sizing degree of 25 to 150 seconds, per 100 $g/m^2$ of the basis weight of the paper sheet substrate.

4. The ink jet recording material as claimed in claim 1, having a bulk density of 0.75 to 1.30 $g/cm^3$ and a thickness of 100 to 300 $\mu$m, each determined in accordance with JIS P8118.

5. The ink jet recording material as claimed in claim 1, wherein the paper sheet substrate is one coated or impregnated with a polyvinyl alcohol compound and a sizing agent.

6. The ink jet recording material as claimed in claim 1, wherein the paper sheet substrate comprises a paper sheet in which cellulose molecules are cross-linked with a cross-linking agent comprising at least one member selected from the group consisting of dialdehyde starches, polyamide-epichlorohydrin resins, polyamide-epoxide resins, urea-formaldehyde resins and melamine-formaldehyde resins, the cross-linking agent having been applied to the paper sheet by adding it into an aqueous pulp slurry for forming the paper sheet, or coating or impregnating the paper sheet with the cross-linking agent.

7. The ink jet recording material as claimed in claim 1, wherein the BET specific surface area of the non-xerogel pigment particles is 50 $m^2/g$ or less.

8. The ink jet recording material as claimed in claim 1, wherein the upper recording layer in the ink receiving layer comprises xerogel porous pigment particles having a BET specific surface area of 100 $m^2/g$ or more.

* * * * *